US005351968A

United States Patent [19]

Starnes

[11] Patent Number: 5,351,968

[45] Date of Patent: Oct. 4, 1994

[54] CAP TOSS GAME

[76] Inventor: Donald W. Starnes, 3529 Colquitt Rd., Shreveport, La. 71118

[21] Appl. No.: 972,567

[22] Filed: Nov. 6, 1992

[51] Int. Cl.[5] ..... A63B 67/06

[52] U.S. Cl. ..... 273/346; 273/400; 273/424; 273/428; 273/DIG. 30

[58] Field of Search ..... 273/346, 345, 347, 336, 273/398, 399, 400, 401, 402, 424, 425, 428, DIG. 30

[56] References Cited

U.S. PATENT DOCUMENTS

| | | | |
|---|---|---|---|
| 285,396 | 9/1883 | Windt | 273/415 |
| 715,249 | 12/1902 | Dunbar | 273/415 |
| 757,440 | 4/1904 | Croxford | 273/401 |
| 810,234 | 1/1906 | Sackett | 273/401 |
| 922,717 | 5/1909 | Parker | 273/415 |
| 1,279,654 | 9/1918 | Charlesworth | 273/401 |
| 1,616,270 | 2/1927 | Madden | 273/401 |
| 2,287,113 | 6/1942 | Markey | 273/401 |
| 3,001,791 | 9/1961 | Atwood | 273/401 |
| 3,964,745 | 6/1976 | Ogg | 273/424 X |
| 4,049,271 | 9/1977 | Fonti | 273/346 |
| 4,565,375 | 1/1986 | Dresel | 273/401 |
| 4,736,955 | 4/1988 | Pollack | 273/336 |
| 4,828,270 | 5/1989 | Chaing | 273/402 X |
| 4,919,436 | 4/1990 | Buselli | 273/346 |
| 5,060,955 | 10/1991 | Bible | 273/400 |

FOREIGN PATENT DOCUMENTS

| | | | |
|---|---|---|---|
| 1489655 | 10/1977 | United Kingdom | 273/346 |

OTHER PUBLICATIONS

*Book of 1,000 Family Games,* Readers Digest Assn., 1991, p. 90, "Bottle-Top Toss".

*Primary Examiner*—William H. Grieb

[57] ABSTRACT

A cap toss game which utilizes a game board having a flat receiving surface which may optionally be fitted with either the pile or loop element of a loop-pile fastener and is provided with an opening in the center that may receive a net. The game board may be suspended from a door or wall or elevated on legs to facilitate tossing bottle caps, with a view toward striking those areas of the game board closest to the opening or, most preferably, tossing the bottle caps through the opening. In a preferred embodiment of the invention the bottle caps are fitted with one element of the loop-pile fastener for engaging the opposite element of the loop-pile fastener attached to the game board and retaining the bottle cap on the game board for scoring purposes.

2 Claims, 2 Drawing Sheets

FIG. 7
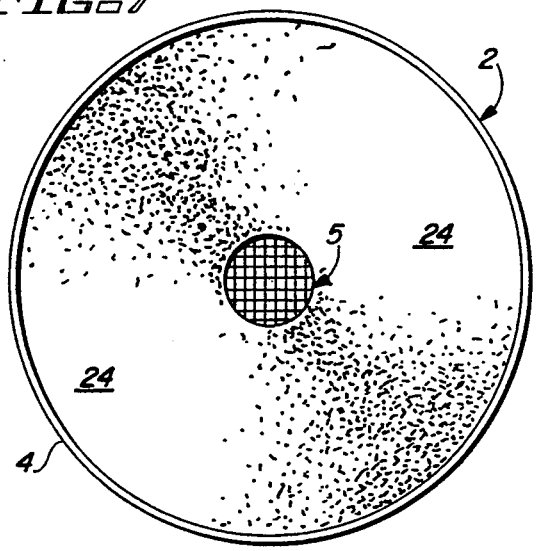
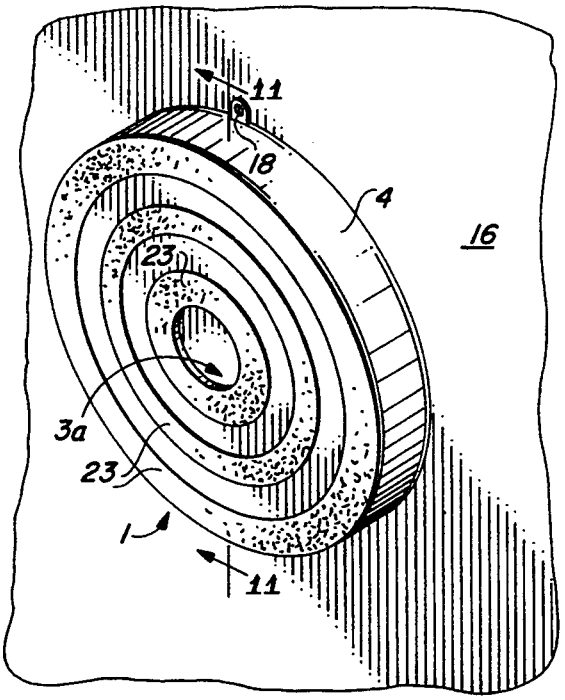
FIG. 10
FIG. 8
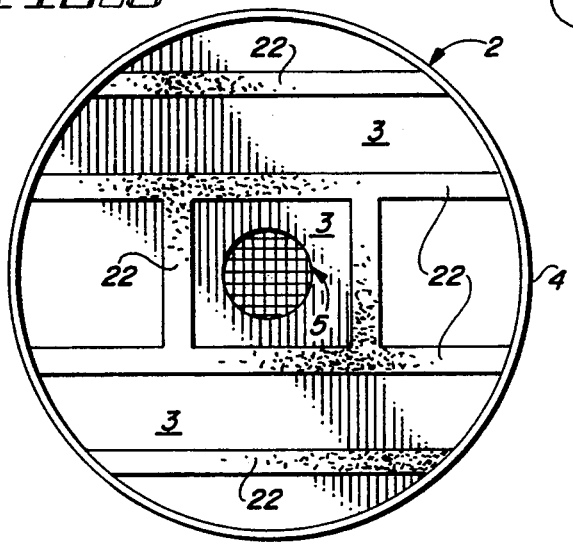
FIG. 9
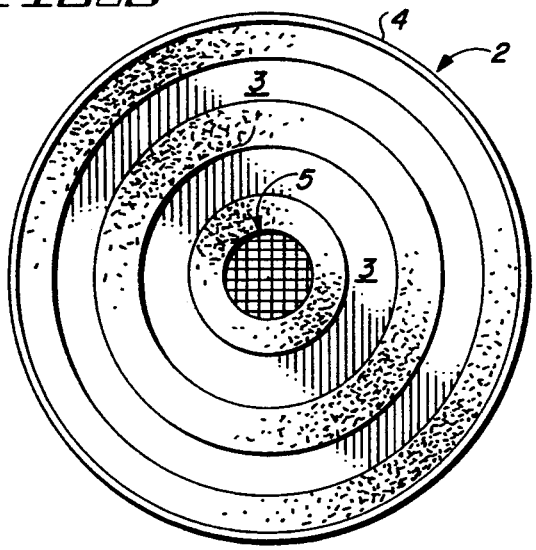
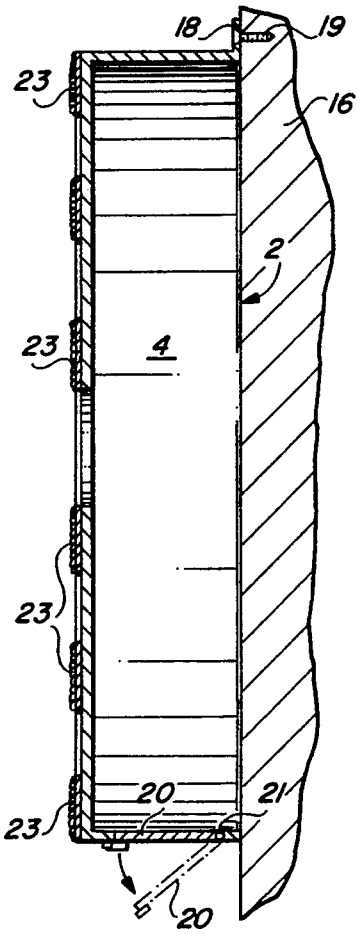
FIG. 11

CAP TOSS GAME

BACKGROUND OF THE INVENTION

1. Field of the Invention

This invention relates to board games requiring manual dexterity, and more particularly, to a cap toss game which is characterized by a game board fitted with a raised border and an opening in the center, wherein bottle caps are tossed or "sailed" at the game board with a view toward projecting the caps through the center opening. In a first preferred embodiment the game board is suspended from a door or wall, with the bottom of the game board facing outwardly to receive the bottle caps through the center opening. In a second and most preferred embodiment the game board is elevated with the border facing upwardly and a net may be mounted below the center opening to retain bottle caps tossed through the opening. In another preferred embodiment of the invention one element of a loop-pile fastener is attached to the game board in a selected pattern and the opposite element of the loop-pile fastener is secured to the bottle caps for retaining the bottle caps on the game board for scoring purposes. In a further preferred embodiment of the invention the second element of the loop-pile fastener which is attached to the bottle cap is constructed as a sleeve which snugly fits over the top of the bottle cap, leaving the concave bottom surface open to facilitate "sailing" of the bottle cap toward the game board.

2. Description of the Prior Art

An early "Game Apparatus for Playing Parlor Quoits" is detailed in U.S. Pat. No. 285,396 dated Sep. 25, 1883, to H. A. DeWendt. The device includes a game board mounted on a frame, to which is suspended a bell which may be struck by a quoit, or bag passing over the central part of the game board. A central opening is provided in the board and the contestants stand at a distance from the board and attempt to toss the bags into the central opening, which counts the highest number of points. Various other scoring may be achieved by striking the game board at certain points. Another game apparatus is detailed in U.S. Pat. No. 715,249, dated Dec. 9, 1902, to E. H. Dunbar. The game apparatus includes a triangular-shaped board mounted on a frame and fitted with multiple holes, underneath which are secured elongated pockets. A projectile such as a leather bag containing small, loose particles is then thrown toward the board, with a view toward tossing the particle-filled leather projectile through one of the openings in the board. A "Game Table" is detailed in U.S. Pat. No. 757,440, dated Apr. 19, 1904. The game table includes a funnel-shaped frame opening upwardly and fitted with canvas panels having multiple pockets shaped therein. The object of the game is to toss a ball into one of the pockets located in the funnel-shaped game table. Another game apparatus is detailed in U.S. Pat. No. 810,234, dated Jan. 16, 1906, to F. L. Sackett. The Sackett game apparatus includes an octagonal-shaped game table provided with multiple openings or pockets and upward-standing rubber pins. An oblate spheroid game piece is projected toward the pockets in the game table by a modified pool cue. Yet another game is detailed in U.S. Pat. No. 922,717, dated May 25, 1909, to G. H. Parker. The game includes a game board pivotally mounted in a case or box and supported by a wire member when the box is in the open configuration. The wire member supports a game board at an angle with respect to the horizontal and the game board is fitted with multiple openings for receiving a projectile tossed by contestants standing at a distance from the game board. U.S. Pat. No. 1,279,654, dated Sep. 24, 1918, to H. M. Charlesworth details a game board tilted on foldable legs with multiple, netted openings therein and a spring-operated catapult located a selected distance from the game board for catapulting a ball toward the game board, with a view toward placing the ball in one of the netted openings. An "Amusement Device" is detailed in U.S. Pat. No. 2,287,113, dated Jun. 23, 1942, to A. J. Markey. The amusement device includes an elevated game board fitted with multiple openings or cups and a sliding tray attached to the game board for recording scores. Each player stands a selected distance from the game board and tries to direct a ball, coin or other playing member toward the target, which is one of the cups in the game board. A "Table Game" is detailed in U.S. Pat. No. 3,001,791, dated Sep. 26, 1961, to G. K. Atwood. The game table is foldable and includes a net extended across the center, as in a ping pong table. A pair of recessed, netted openings are provided in the table on each side of the net and the object of the game is to direct a ping pong ball over the net and into the netted opening.

It is an object of this invention to provide a cap toss game which includes a game board fitted with at least one opening, through which bottle caps are tossed or "sailed" for scoring points.

Another object of the invention is to provide a cap toss game which includes a game board that may be vertically or horizontally oriented, which game board is fitted with at least one opening for receiving bottle caps tossed or "sailed" by competitors standing at a distance from the game board.

Yet another object of this invention is to provide a cap toss game which includes a horizontally-oriented game board having an upward-standing border and a center opening, through which opening contestants attempt to toss a bottle cap while standing at a distance from the game board.

Yet another object of this invention is to provide a cap toss game which is characterized by an elevated, horizontal game board fitted with a raised border, a central opening, a net provided beneath the opening and a first element of a loop-pile fastener provided in a selected pattern on the game board, with a second element of the loop-pile fastener secured to a bottle cap, such that tossing the bottle cap toward the game board causes the bottle cap to stick to the game board and determine scoring by the contestants.

SUMMARY OF THE INVENTION

These and other objects of the invention are provided in a cap toss game which is characterized by a game board that may be suspended vertically or horizontally and is fitted with an opening, at which bottle caps are "sailed" to accumulate points. In a preferred embodiment the game board is circular, is elevated in horizontal configuration and is fitted with a raised border and a fixed or removable net beneath the opening to catch the bottle caps. In a still further preferred embodiment, a first element of a loop-pile fastener is applied to the game board surface in a selected pattern and a second element of the loop-pile fastener is attached as a sleeve to the top portion of the bottle cap, to facilitate sailing of the bottle cap at the game board and attachment of the bottle cap to the game board to determine scoring.

BRIEF DESCRIPTION OF THE DRAWINGS

The invention will be better understood by reference to the accompanying drawings, wherein:

FIG. 7 is a top view of the game board, more particularly illustrating a pile element field applied to the game board;

FIG. 8 is a top view of a pile element strip pattern applied to the game board illustrated in FIG. 1;

FIG. 9 is a top view of a concentric circle pile element configuration of the game board illustrated in FIG. 1;

FIG. 10 is a perspective view of an alternative vertical mounting of the game board illustrated in FIG. 1, wherein the game board is fitted with the concentric circle pile element configuration illustrated in FIG. 9; and FIG. 11 is a sectional view taken along line 11—11 of the vertically-oriented game board illustrated in FIG. 10.

DESCRIPTION OF THE PREFERRED EMBODIMENTS

Figure 2:
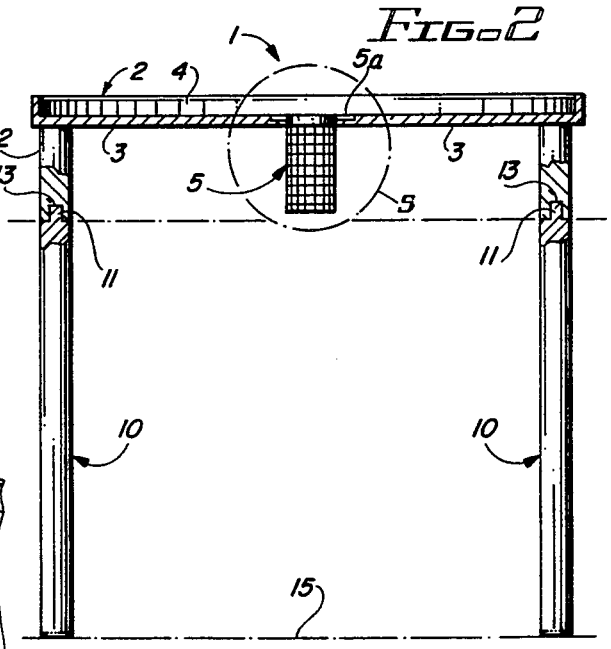
FIG. 2 is a sectional view taken along line 2—2 of the game board illustrated in FIG. 1.
Figure 4:
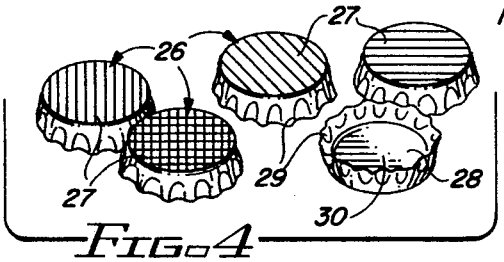
FIG. 4 is a perspective view of multiple bottle caps which are "sailed" toward the game board by contestants.
Figure 5:
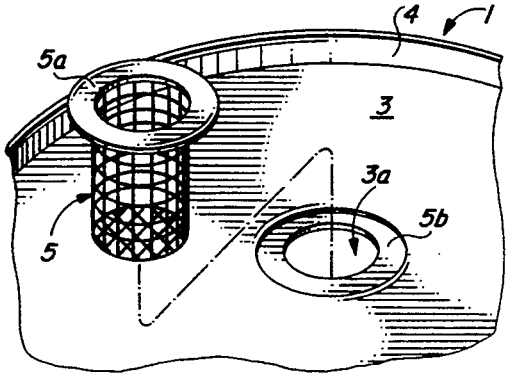
FIG. 5 is an enlarged perspective, sectional view of the center portion of the game board illustrated in FIG. 1, more particularly illustrating a removable net.
Figure 6:
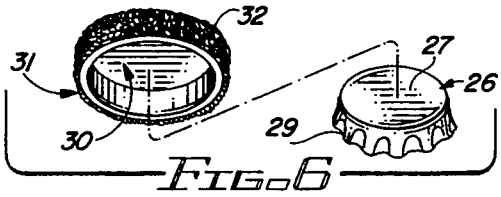
FIG. 6 is a perspective view of a bottle cap, more particularly illustrating a loop element sleeve for receiving the bottle cap.

Referring initially to FIGS. 1, 2, 4 and 5 of the drawings, the cap toss game of this invention is generally illustrated by reference numeral 1. The cap toss game i is characterized by a circular game board 2, fitted with a flat board base 3 having a central base opening 3*a* and a raised board perimeter 4. The game board 2 is supported by game board legs 10 that extend from a supporting surface 15 to meet leg mounts 12, attached to the board base 3 of the game board 2 near the board perimeter 4, as further illustrated in FIG. 2. In a preferred embodiment of the invention the leg mounts 12 are fitted with pin receptacles 13 that receive corresponding leg pins 11, extending from the game board legs 10, respectively. In another preferred embodiment of the invention a net 5 is suspended beneath the base opening 3*a* in the board base 3, as further illustrated in FIGS. 1 and 2. In a most preferred embodiment the board base 3 is fitted with a recessed ring seat 5*b*, which receives the net ring 5*a* of a net 5, as illustrated in FIGS. 2 and 5. Accordingly, the net ring 5*a* and net 5 are removable from the base opening 3*a* for packaging and storage purposes. Alternatively, it will be recognized that the net 5 may be permanently mounted to the board base 3 beneath the base opening 3*a*, as desired. In the embodiment of the invention illustrated in FIGS. 1 and 2 the board base is smooth, thereby facilitating tossing, "sailing" or "floating" the bottle caps 26, illustrated in FIG. 4, toward the game board 2, with a view towards causing the bottle caps 26 to directly deposit in the net 5. This objective is more often realized by first impinging the bottle caps 26 on the flat, smooth board base 3 and sliding the bottle caps 26 into the net 5.

Figure 1:
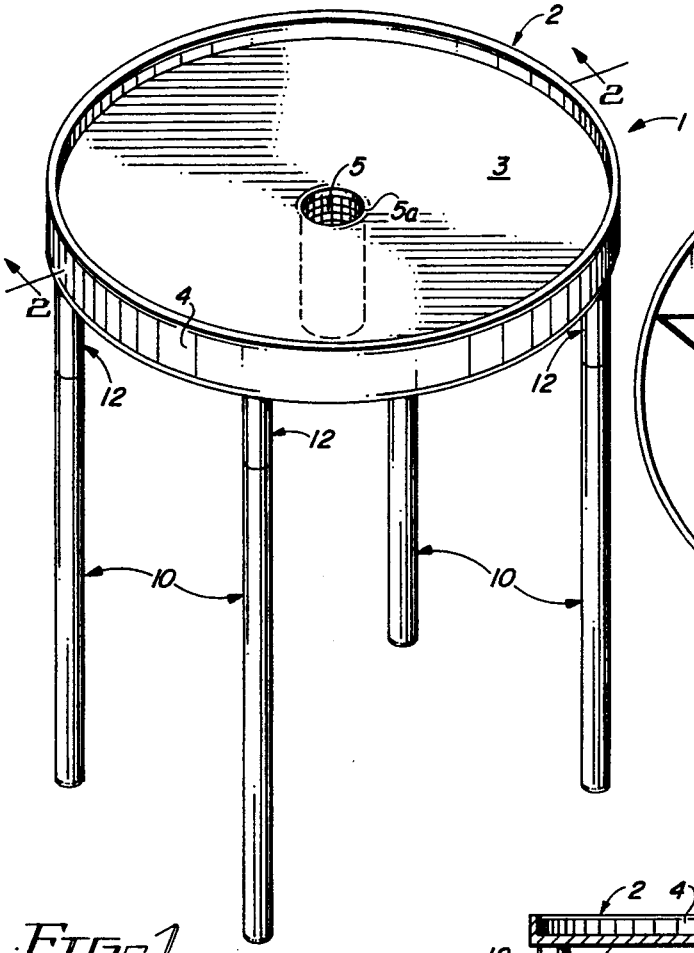
FIG. 1 is a perspective view of a most preferred embodiment of the cap toss game, wherein the game board is oriented in a horizontal, elevated configuration.
Figure 3:
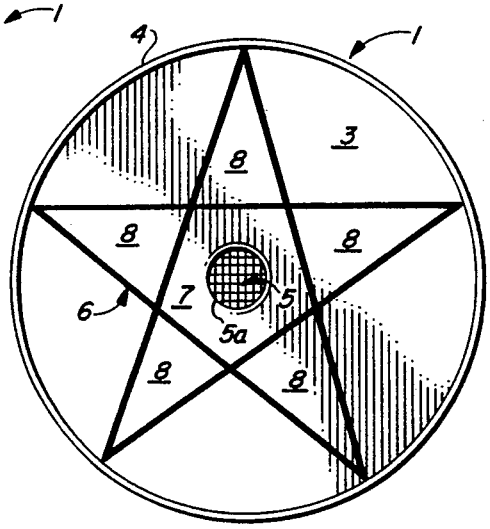
FIG. 3 is a top view of the game board, more particularly illustrating a first preferred pattern for the game board.

Referring now to FIG. 3 of the drawings, in another preferred embodiment of the invention a star pattern 6 is superimposed on the top surface of the board base 3 and various numbers are applied to the interior pattern zone 7 and exterior pattern zones 8 of the star pattern 6, as well as the remaining surface of the board base 3, to indicate scoring when the bottle caps 26 are tossed and "sailed" onto the board base 3. It will be appreciated by those skilled in the art that the highest number of points is scored when the bottle caps 26 fall either directly, or slide into the net 5. It will also be apparent to those skilled in the art that other designs, patterns and layouts may be superimposed on the top surface of the board base 3 of the game board 2, with various numbering and/or lettering systems utilized according to the knowledge of those skilled in the art, to facilitate a scoring pattern or patterns which are satisfactory to the contestants.

Referring now to FIGS. 1, 2, 6 and 7 of the drawings, in another preferred embodiment of the invention a pile field 24 is added to the entire top surface of the board base 3 of the game board 2 and each of the bottle caps 26 is fitted with a corresponding loop sleeve 31, which is constructed of a loop element 32 and is shaped to define a sleeve cavity 33. The cap top 27 of each of the bottle caps 26 is forced into the slightly smaller sleeve cavity 33, to stretch the loop sleeves 31 around the serrated cap sides 29 of the respective bottle caps 26, leaving the cap cavity 30 open. Accordingly, the cap top 27 is forced into the corresponding sleeve cavity 33 of the loop sleeves 31, respectively, such that the bottle caps 26 can be "sailed" or "floated" toward the game board 2 and the loop elements 32 of the loop sleeves 31 engage various areas of the pile field 24 on the board base 3 and cause the bottle caps 26 to remain in the struck position, thereby making it more difficult for the bottle caps 26 to enter the net 5. It will be appreciated by those skilled in the art that various patterns and number and lettering indicia may be applied to the pile field 24 for scoring purposes; for example, the star pattern 6 illustrated in FIG. 3 may be superimposed on the pile field 24, as desired.

Referring now to FIG. 8 of the drawings, the board base 3 may be fitted with a series of pile strips 22 arranged in any desired configuration to define a pattern of desired size and width for engaging the loop sleeves 31 on the respective bottle caps 26. It will be appreciated by those skilled in the art that the pile strips 22 may be of any desired width and may be located on the board base 3 to increase or decrease the difficulty of "floating" or "sailing" the bottle caps 26 into the centrally located net 5.

Referring to FIG. 9 of the drawings, in another preferred embodiment of the invention concentric pile circles 23 may be attached to the board base 3 of the game board 2 to further increase the difficulty of sailing the bottle caps 26, fitted with loop sleeves 31, into the net 5. As in the case of the pile strips 22 illustrated in FIG. 8, the pile circles 23 illustrated in FIG. 9 may be of any desired width to adjust the degree of difficulty desired.

Referring now to FIGS. 10 and 11 of the drawings, in an alternative preferred embodiment of the invention the game board 2 may be suspended vertically from a wall 16 by means of a support tab 18 and a fastener 19, with the net 5 removed and the bottom of the board base 3 facing outwardly to create an internal cavity defined by the board base 3, board perimeter 4 and the wall 16. An access door 20 may be attached to the bottom portion of the board perimeter 4 by means of a door hinge 21 to facilitate removing bottle caps 26 which are "floated", "sailed" or tossed through the base opening 3*a*. As in the case of the game board 2 illustrated in FIG. 9, the pile circles 23 may be provided on the board base 3. Alternatively, various other patterns of pile element may be applied to the board base 3, as in the case of the pile strips 22, illustrated in FIG. 8.

It will be appreciated by those skilled in the art that the cap toss game of this invention is highly versatile, in that the bottle caps 26 may be "sailed", "floated" or tossed, as desired, toward a game board 2 of any desired orientation and size, with or without the loop sleeves 31. For example, even under circumstances where the board base 3 of the game board 2 is not fitted with either the pile field 24, pile strips 22 or pile circles 23, illustrated in FIGS. 7, 8 and 9, respectively, the loop sleeves 31 serve to reduce the sliding motion of the bottle caps 26 when they strike the smooth surface of the board base 3. This limited sliding feature makes entry of the bottle caps 26 in the net 5 more difficult. The game is rendered even more difficult by application of the loop sleeves 31 to the bottle caps 26 under circumstances where either the pile field 24, pile strips 22 or pile circles 23 are utilized on the board base 3, since there is no sliding action of the bottle caps 26.

It will be further appreciated by those skilled in the art that great skill may be developed in "sailing" and "floating" the bottle caps 26 toward the game board 2 and the bottle caps 26 may be color-coded as indicated in FIG. 4. Furthermore, the loop sleeves 31 may also be color coded, as desired. Moreover, projectiles other than bottle caps 26 may be utilized in the cap toss game 1, although both threaded and unthreaded bottle caps having a cap cavity 30 are much preferred because of the "sailing" and "floating" characteristics of such projectiles.

Accordingly, while the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A cap toss game comprising a substantially flat game board having a border raised above the plane of said game board, said game board oriented in a substantially horizontal plane; a first element of a loop-pile fastener provided on said game board; support means provided on said game board for supporting said game board; at least one opening provided in said game board; bottle caps, each having a round side, a flat top and a concave bottom, for tossing toward said game board at said opening; and a second element of a loop-pile fastener provided on said side and said flat top of each of said bottle caps as a sleeve, whereby said sleeve covers said side and said flat top of each of said bottle caps, leaving said concave bottom of said bottle caps open and said first element engages said second element when said bottle caps are tossed on said game board.

2. The cap toss game of claim 1 wherein said game board is circular and said at least one opening comprises a single opening located substantially in the center of said game board and further comprising a net suspended from said game board beneath said opening for collecting said bottle caps.

* * * * *